United States Patent [19]

Skinner

[11] 4,372,388

[45] Feb. 8, 1983

[54] SUBSURFACE CONTROL VALVE

[75] Inventor: Neal G. Skinner, Duncan, Okla.

[73] Assignee: Halliburton Company, Duncan, Okla.

[21] Appl. No.: 209,621

[22] Filed: Nov. 24, 1980

[51] Int. Cl.[3] ..... E21B 34/12

[52] U.S. Cl. ..... 166/334; 166/124; 166/128; 166/152; 166/145

[58] Field of Search ..... 166/145, 152, 124, 125, 166/128, 334; 285/302

[56] References Cited

U.S. PATENT DOCUMENTS

| | | | |
|---|---|---|---|
| 3,253,655 | 5/1966 | Brown | 166/124 |
| 3,306,363 | 2/1967 | McZilkey, Jr. | 166/152 |
| 3,306,366 | 2/1967 | Muse | 166/334 |
| 3,356,140 | 12/1967 | Young | 166/128 |
| 3,570,595 | 3/1971 | Berryman | 166/128 |
| 4,253,521 | 3/1981 | Savage | 166/128 |
| 4,290,484 | 9/1981 | Beall | 285/302 |

OTHER PUBLICATIONS

Specifications of Halliburton "model 2 RTTS" and SSC valve from pp. 3476–3477, 3485 of Halliburton Catalog.

*Primary Examiner*—William F. Pate, III
*Attorney, Agent, or Firm*—Joseph A. Walkowski; Thomas R. Weaver

[57] ABSTRACT

A subsurface control valve for use in shutting off a well bore. The valve comprises a valve assembly and a stinger assembly, which is run into the well bore on drill pipe with a packer placed below the valve in the string. The valve is open as the string is run into the well bore, the packer then being set, and a sliding valve in the tool being closed by a plurality of rotations of the stinger assembly, which is removed from the well bore after the sliding valve is closed. To re-open the sliding valve, the stinger assembly is run back into the well bore, into the valve assembly, and rotated a number of times in the opposite direction. The present invention includes a spring-loaded stinger to constantly bias the stinger into engagement with the sliding valve and a bearing on the stinger assembly to facilitate alignment and rotation between the stinger assembly and valve assembly so as to limit the torque applied to the valve assembly.

8 Claims, 8 Drawing Figures

SUBSURFACE CONTROL VALVE

BACKGROUND OF THE INVENTION

It is desirable, in fact necessary in many instances, to have an apparatus permitting the shutoff and temporary abandonment of a petroleum well during the course of drilling. This operation may be required while drilling offshore as a storm approaches, or while a blowout preventor is being changed or repaired.

A prior art mechanism for shutting off a well is the Halliburton Services SSC (subsurface control) Valve, described on page 3485 of the Halliburton Services Sales and Service Catalog Number 40. The SSC Valve comprises a stinger assembly and a valve assembly, which are made up and run together into the casing on drill pipe with a packer, such as a Halliburton Services RTTS packer, described on pages 3476–3477 of the aforementioned Halliburton Services catalog. The SSC Valve is run open into the casing, the packer being set with righthand rotation at the desired depth. The drill pipe is then rotated to the left, backing off the stinger assembly from the valve assembly, to which it is threaded. As the stinger backs off, it pulls a sliding valve in the valve assembly upward, closing the SSC Valve. At a certain point during the withdrawal of the stinger, spring fingers on the sliding valve pop into a recess in the bore of the valve assembly, locking the sliding valve in the closed position, and disengaging it from the stinger, which is then pulled to the surface on the drill pipe. The packer supports the SSC Valve and the drill pipe below it until it is desired to recommence drilling, at which point the stinger assembly is run back into the valve assembly, and rotated to the right, which re-opens the sliding valve and makes up the stinger assembly with the valve assembly again. An upward pull on the pipe string then unseats the packer, and the string can then be returned to the surface or circulation re-established and drilling continued.

While the subsurface control valve of the prior art does permit shutoff of a well during drilling, it possesses several operational difficulties which significantly impede its performance and reliability. When the stinger assembly is re-inserted into the valve assembly, there is a significant initial shock even if the operator is extremely careful, due to the weight of the pipe string and stretch in the string, which makes exact calculation of the point of contact impossible. When the threaded portions of the two assemblies make contact, the force is taken by the makeup threads often causing damage. As the stinger enters the valve assembly and contacts the sliding valve, it generally orients the two assemblies with respect to one another. However, there is no assurance that the threads of the two assemblies will be accurately aligned. As a result, in some instances when the threads jam or do not mate precisely, other threaded joints in the valve assembly may be fractured due to the excess torque applied due to the jammed or misaligned threads between the two assemblies. Furthermore, there is no way to accurately control the amount of axial force applied to the threads, the force being solely a function of how much pipe weight is set down. If too much is permitted, the threads may jam, or fracture if weight is applied suddenly.

SUMMARY OF THE INVENTION

In contrast to the prior art, the present invention comprises a subsurface control valve that assures proper alignment of the stinger with the sliding valve of the valve assembly, and restricts the amount of force applied to the makeup threads of the stinger and valve assemblies.

The present invention, like the prior art, comprises a stinger assembly and a valve assembly. However, the bottom of the stinger assembly possesses an annular bearing to facilitate the rotation of the stinger assembly after it contacts the valve assembly. Moreover, the stinger is not axially fixed to the stinger assembly, but is axially slidable and is spring-biased axially downward. However, the stinger is slidably splined to the interior of the stinger assembly to prevent its rotation within the assembly. The spring-bias of the stinger provides the makeup force for the threading of the stinger to the valve assembly, the bearing on the bottom of the stinger assembly surrounding the stinger taking up the weight of the pipe string and facilitating rotation of the stinger.

Thus, the subsurface control valve of the present invention is run into the casing on a pipe string with a packer below it, the valve being open. The packer is set with righthand rotation, and the stinger backed off from the valve assembly, closing a sliding valve in the valve assembly to shut off the well bore below the packer. The stinger assembly is then pulled out of the hole. When it is desired to open up the well bore again, the stinger assembly is re-inserted in the well bore casing, and run down to the level of the valve assembly. The stinger enters the valve assembly, and contacts the sliding valve, which has been held closed by spring fingers. When the exterior of the stinger assembly contacts the top of the valve assembly, the force is borne by the annular bearing on the bottom of the stinger assembly. As this contact occurs, the threads on the stinger will be biased against those in the valve assembly by the stinger spring. As the stinger assembly is rotated, the spring provides an adequate but limited force to ensure thread makeup, and the resting of the stinger assembly bearing on the exterior of the valve assembly assures alignment of the stinger and its ease of rotation. When the stinger assembly is fully made up to the valve assembly, the sliding valve of the valve assembly is opened, and the string can be pulled from the hole with an upward force which will unseat the packer. It is therefore readily apparent that the present invention comprises a new and more reliable subsurface control valve, possessing numerous advantages over the prior art.

BRIEF DESCRIPTION OF THE DRAWINGS

The present invention will be more readily understood by reference to the detailed description set forth hereafter, taken in conjunction with the accompanying drawings in which.

DESCRIPTION OF THE PREFERRED EMBODIMENT

Figure 1A:
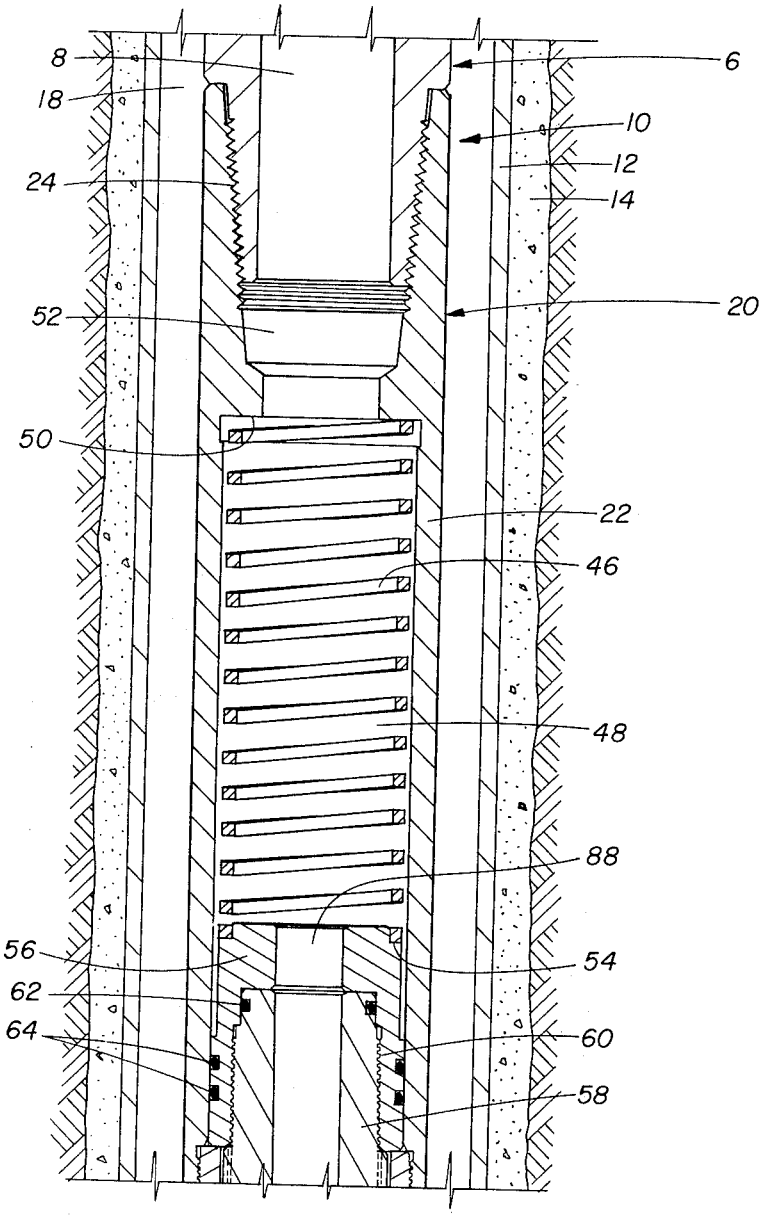
FIGS. 1A, 1B and 1C are vertical cross-sectional elevations of the subsurface control valve of the present invention as it is run into a cased well bore on a drill string.
Figure 1B:
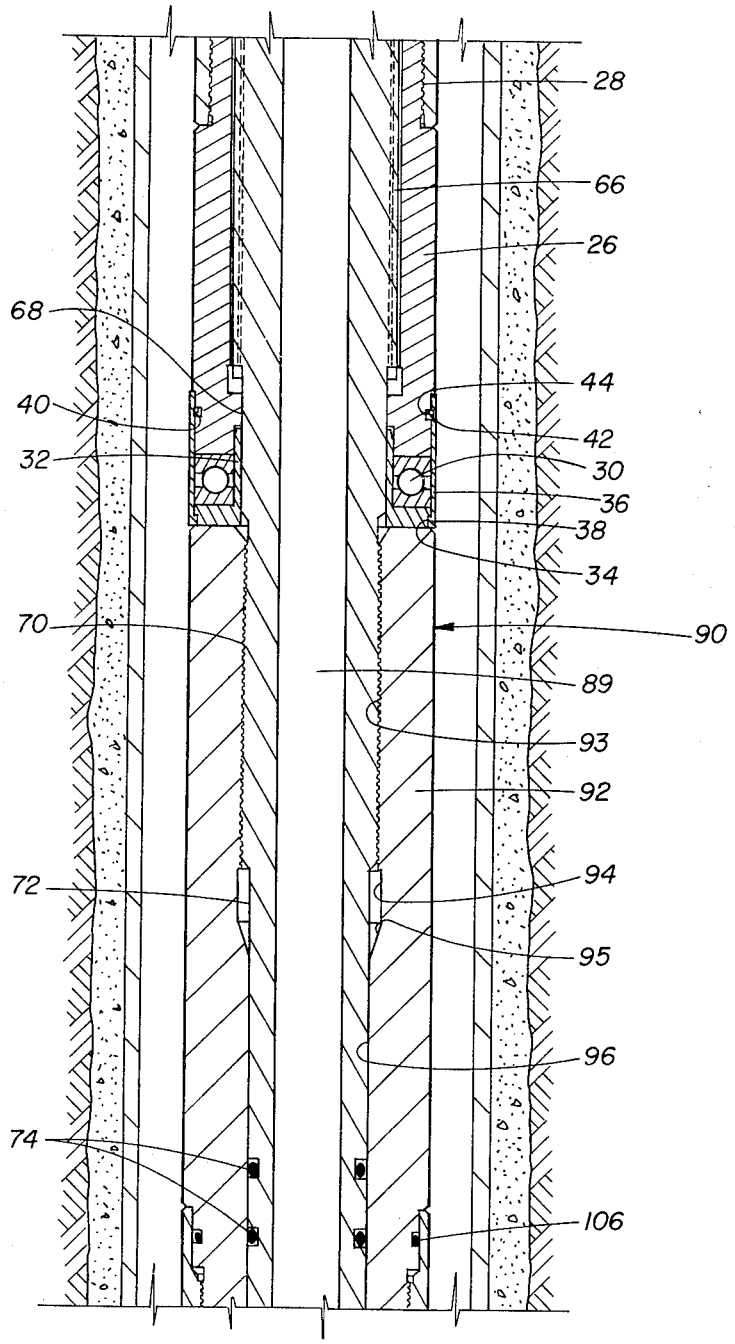
Figure 1C:
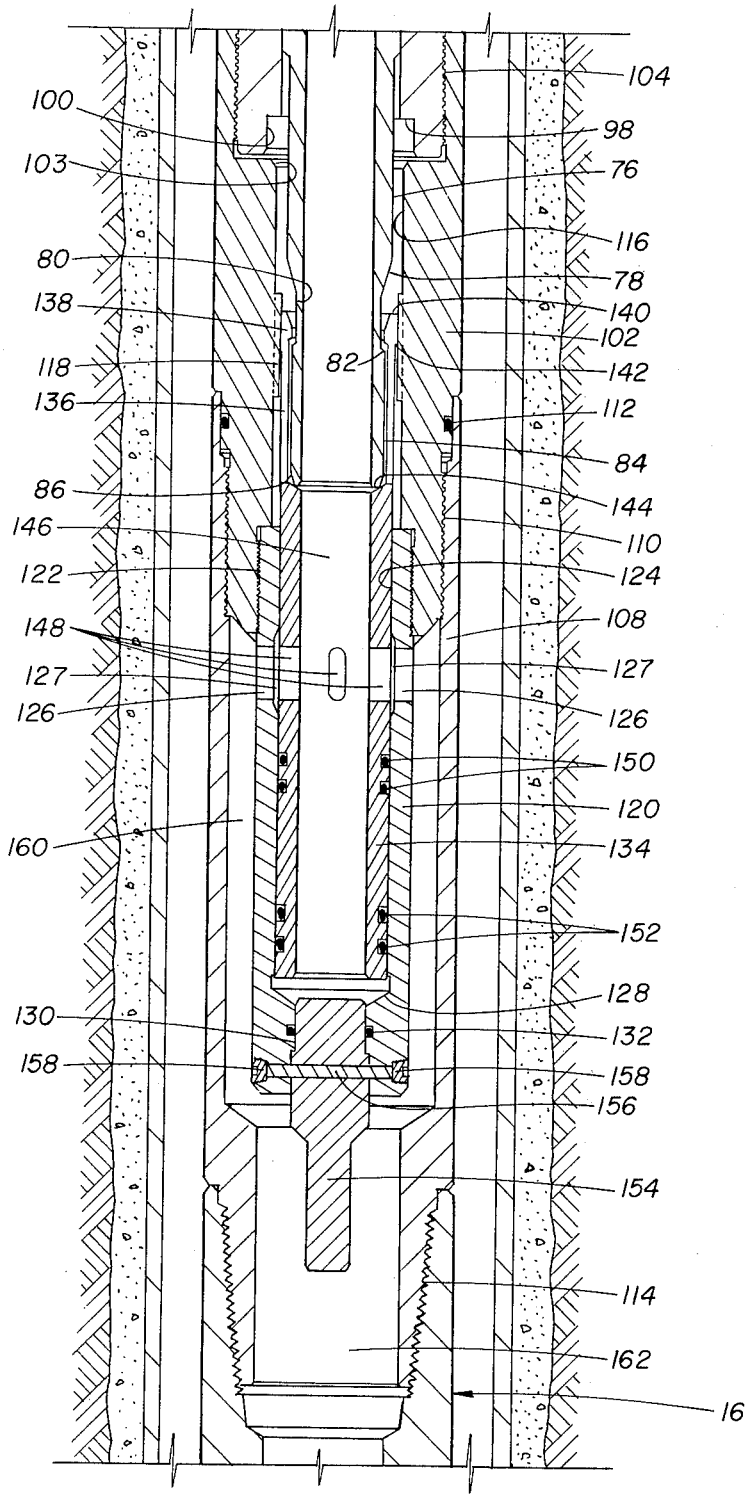

Referring to FIGS. 1A–1C, the preferred embodiment of the subsurface control valve of the present invention is described hereafter.

The subsurface control valve 10 of the present invention comprises stinger assembly 20 and valve assembly 90, which are shown made up in a well bore extending through an earth formation lined with casing 12, which is supported by cement 14. The subsurface control valve 10 is suspended in the well bore from tubing or drill pipe 6 having bore 8 therethrough. Below the subsurface control valve 10 is disposed a suitable packer, the top of which is generally designated by the numeral 16 such as the Halliburton Services RTTS Packer, described on pages 3476–77 of Halliburton Services Sales and Service Catalog Number 40, or a Champ® II Packer, described on page 3475 of the same catalog. Annulus 18 above packer 16 surrounds the subsurface control valve 10 and pipe string 6.

Stinger assembly 20 comprises upper adapter 22, which is threaded at its upper end to drill pipe 6 at junction 24, and at its lower end to bearing support 26 at junction 28. Annular bearing 30 abuts the lower end of bearing support 26, and is supported on its inner and lower extents by bearing holder 32 having annular undercut 34 on its outer diameter. Shoulder 38 at the lower end of bearing retainer 36 extends into undercut 34 of bearing holder 32, bearing retainer 36 being secured to bearing support 26 by the expansion of snap ring 40 into annular recess 42 at the top of bearing retainer 36 from annular recess 44 on exterior of bearing support 26. Bearing support 26 is thus free to rotate on bearing 30 when stinger assembly 20 is made up to valve assembly 90, to be described later in detail.

Coil spring 46 is disposed in bore 48 of upper adapter 22, and abuts shoulder 50 which leads to bore 52, in communication with bore 8 of pipe string 6. The lower end of spring 46 extends to annular shoulder 54 at the top of mandrel retainer 56, which is threaded to seal mandrel 58 at junction 60, a fluid seal being made therebetween by O-ring 62. A slidable fluid seal is effected between the exterior of mandrel retainer 56 and the wall of bore 48 by O-rings 64. The exterior of seal mandrel 58 is axially slidably splined to the interior of bearing support 26 at 66. Below splined area 66, seal mandrel 58 possesses an area of substantially uniform diameter 68, followed by acme threaded area 70. Below area 70, the outer diameter of seal mandrel 58 is reduced at 72, area 72 possessing annular recesses in which O-rings 74 are disposed. Seal mandrel 58 steps to a still smaller outer diameter 76 near its lower end, which diameter 76 leads via annular beveled surface 78 to shallow annular recess 80, bounded on its lower edge by short annular incline 82, which in turn leads to cylindrical surface 84 terminating in chamfered end 86.

Mandrel retainer 56 has bore 88 therethrough, which communicates with bore 46 of upper adapter 22 and with bore 89 extending through seal mandrel 58.

Valve assembly 90 comprises upper body 92, which abuts the bottom of bearing holder 32, and is threaded to acme threads 70 of seal mandrel 58 at acme thread 93. Below acme thread 70, the bore of upper body 92 becomes cylindrical for a short distance 94, then tapers inwardly at 95 to diameter 96, against which O-rings 74 on seal mandrel 58 make a slidable fluid seal. At the lowermost extent of upper body 92 radial undercut 98 enlarges the bore diameter to area 100.

Upper body 92 is threaded to circulating body 102 at junction 104, O-ring 106 making a fluid seal. Circulating body 102 is threaded to lower body 108 at junction 110, O-ring 112 making a fluid seal. Packer 16 is threaded to lower body 108 at junction 114.

The inside of circulating body 102 possesses smooth bore 116, from which extend inwardly splines 118. At the lower end of circulating body 102 is valve housing 120, threaded and welded to circulating body 102 at 122. Bore wall 124 of valve housing 120 is pierced by a plurality of radial apertures 126, possessing enlarged undercuts 127 at their inner extent. While four equally spaced apertures are employed in the preferred embodiment of the present invention, any number may be utilized. In the preferred embodiment, two opposed apertures 126 are radially aligned with splines 118, the purpose of such alignment becoming apparent hereafter. At the lower extent of bore wall 124, oblique annular surface 128 leads to reduced stepped bore 130, the upper portion of which contains O-ring 132.

Sliding valve 134 slides within valve housing 120, and comprises spring fingers 136 having protrusions 138 at the top, spring fingers 136 having slots therebetween which slidably cooperate with splines 118, the radially outermost extent of protrusions 138 contacting the wall of bore 116 in an outwardly biased manner. Thus, rotation of sliding valve 134 with respect to circulating body 102 is prohibited, as shown in FIG. 1C, due to the interaction of splines 118 and spring fingers 136. Protrusions 138 also possess flat upper surfaces 140, and oblique lower surfaces 142, which are oriented at substantially the same angle as beveled annular surface 103 at the top of circulating body 102. Below spring fingers 136 is shoulder 144 which leads to bore 146, extending to the bottom of sliding valve 134. Four radial apertures 148 spaced at 90° intervals extend through the wall of sliding valve 134, apertures 148 being aligned with the slots between spring fingers 136, thereby ensuring the alignment of apertures 148 with radial apertures 126 in valve housing 120. O-ring sets 150 and 152 provide a slidable fluid seal between sliding valve 134 and valve housing 120.

Plug 154 extends into stepped bore 130 of lower body 120, a fluid seal between plug 130 and lower body 120 being made by O-ring 132. Plug 154 is held in place by shear pin 156, which in turn is laterally secured by pipe plugs 158.

Annular bore 160 communicates with bore 146 of sliding valve 134 through apertures 126 and 148, and extends into lower bore 162 leading to packer 16.

It should be noted that the valve assembly 90 is preferably made up to the stinger assembly 20 with a large acme thread, such as a 4 stub acme, to reduce the number of rotations required to make up the tool. In the prior art, use of such a large thread may result in problems, due to the fact that a smaller, 6 stub acme thread is employed to assemble the valve assembly components. Because a 6 stub thread possesses a greater mechanical advantage than the 4 stub thread, the 4 stub thread could bind during withdrawal of stinger assembly 20, resulting in the 6 stub thread breaking out with resultant disassembly of valve assembly 90. This potential difficulty is solved in the present invention, as far less force is applied to the 4 stub threads due to the isolation of pipe string weight from valve assembly 20 through use of a floating, spring biased stinger and reduction of needed backoff torque through use of a bearing assembly at the junction of bearing support 26 of stinger assembly 20 and upper body 92 of valve assembly 90.

OPERATION OF THE PREFERRED EMBODIMENT

Referring to all of the drawing figures, operation of the preferred embodiment of the subsurface control valve of the present invention is described hereafter.

Subsurface control valve 10 is run into the well bore as shown in FIGS. 1A–1C, at the end of a pipe or tubing string 6. A packer 16, such as the Halliburton Services RTTS Packer, is run in the string directly below subsurface control valve 10. By way of example and not by way of limitation, the operational parameters of the RTTS Packer will be used to describe the operation of subsurface control valve 10. Specifically, packer 16 is a righthand set packer with a hydraulic hold-down to engage the casing in response to pressure below the packer, and an automatic J-slot to permit retrieval of the packer by an upward pull of the pipe string without rotation.

Figure 2A:
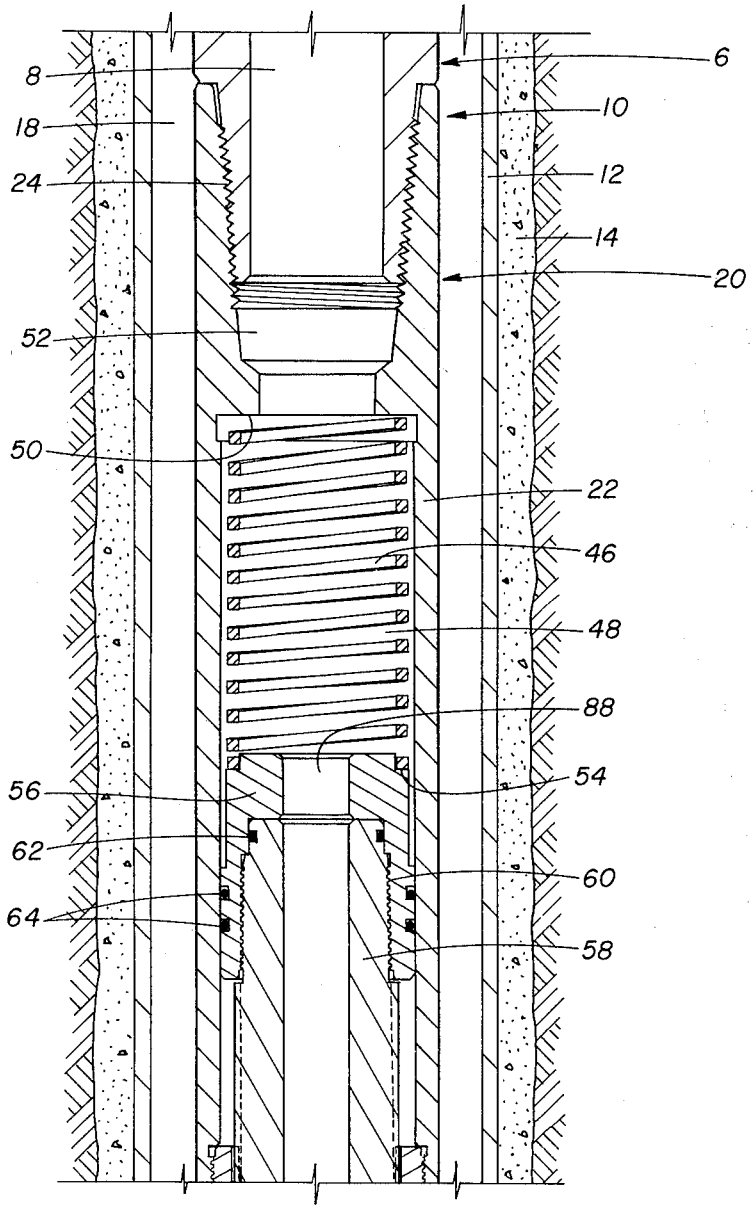
FIGS. 2A, 2B and 2C are vertical cross-sectional elevations of the subsurface control valve of the present invention as it is being closed.
Figure 2B:
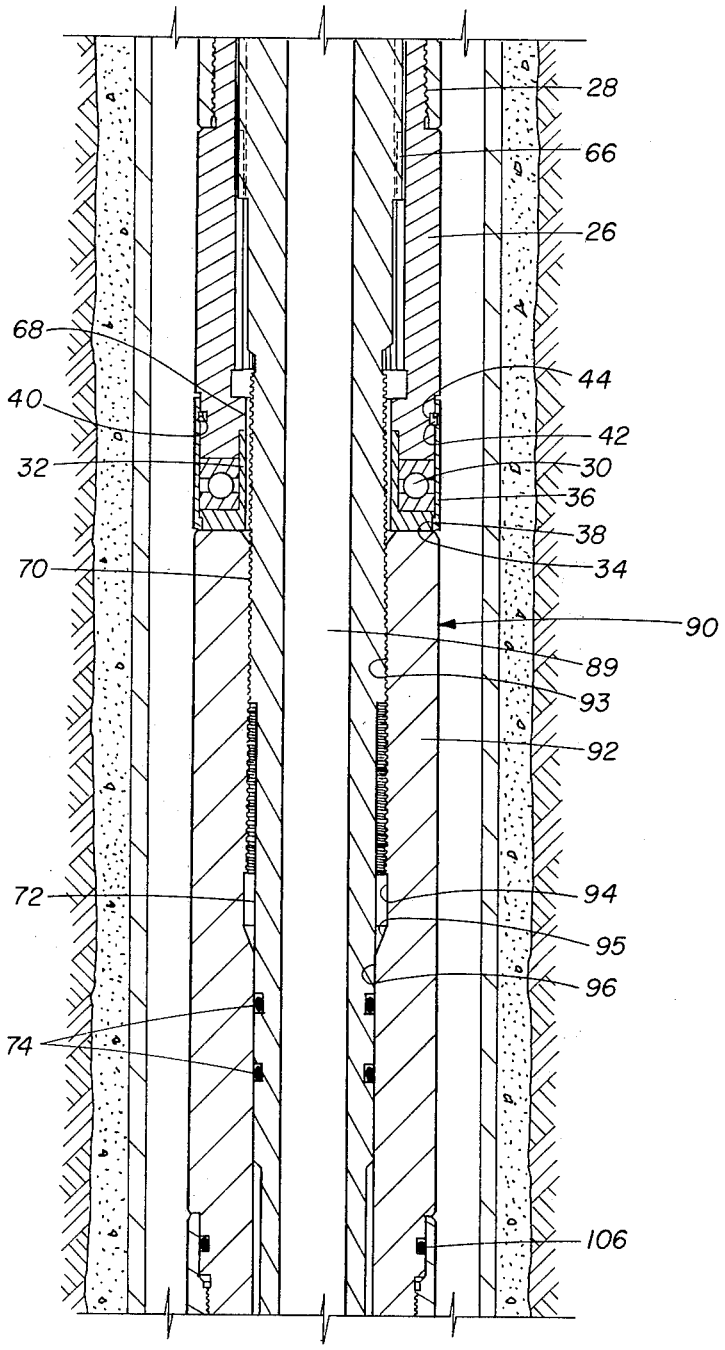
Figure 2C:
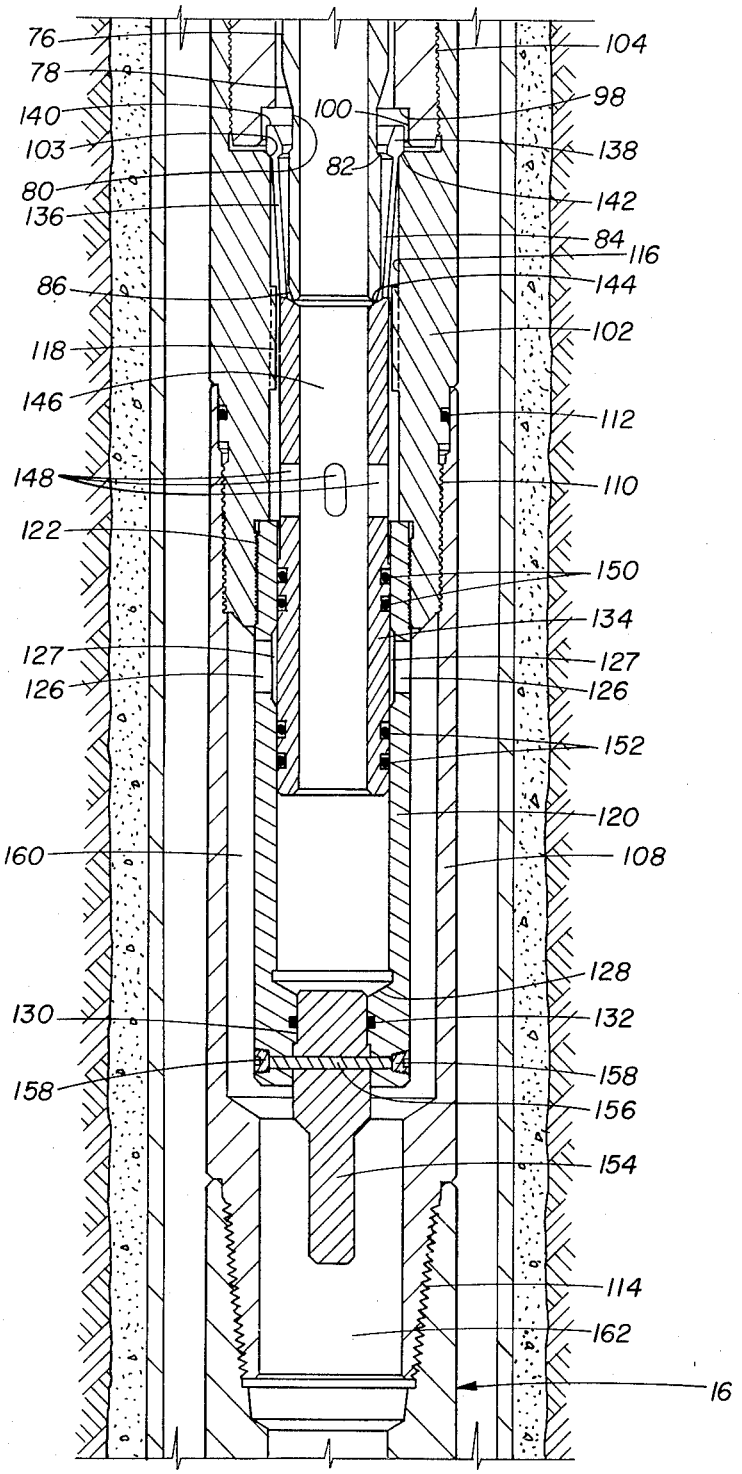

Subsurface control valve 10 is located at the desired well bore depth, at which time packer 16 is set with righthand rotation of pipe string 6. As subsurface control valve 10 is run into the well bore, apertures 126 are aligned with apertures 148, allowing fluid in the well bore to move freely through packer 16 and pipe string 6. After packer 16 is set, pipe string 6 is rotated to the left, which backs off the threads 70 of seal mandrel 58 from the threads 93 of upper body 92, as seal mandrel 58 is slidably splined to the interior of bearing support 26. This results in the "stinger" portion of the stinger assembly, comprising seal mandrel 58 and mandrel retainer 56, compressing spring 46 against shoulder 50 in upper adapter 22, the exterior of the stinger assembly comprising upper adapter 22 and bearing support 26 with its bearing assembly being held in contact with valve assembly 90 by the weight of pipe string 6. As seal mandrel 58 backs off from valve assembly 90, annular incline 82 on seal mandrel 58 contacts protrusions 138 on spring fingers 136 at the top of sliding valve 134, and pulls sliding valve 134 axially upward, sliding valve 134 being guided by the interaction of splines 118 and spring fingers 136. When protrusions 138 of spring fingers 136 reach beveled annular surface 103 on circulating body 102, the outward bias of spring fingers 136 forces protrusions 138 into contact with surface 103 and away from annular incline 82 and seal mandrel 58, as shown in FIGS. 2A–2C. In this position, apertures 148 are above apertures 126 in valve housing 120, and seal rings 150 and 152 bracket on sliding valve 134 bracket apertures 126, isolating seal mandrel bore 146 from lower bore 162. The well bore below packer 16 is now isolated from both pipe string 6 and annulus 18 above packer 16.

Figure 3A:
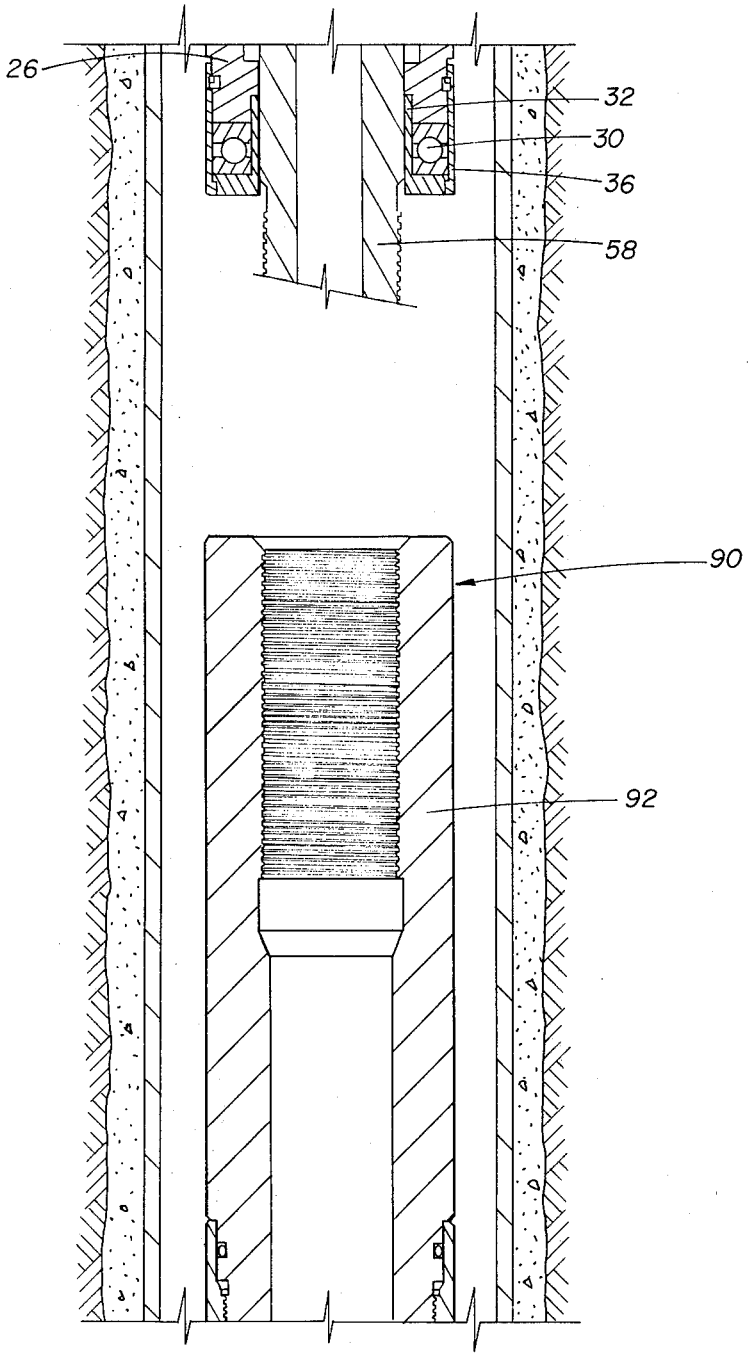
FIGS. 3A and 3B are vertical cross-sectional elevations of the subsurface control valve of the present invention after it has been closed and the stinger assembly is being removed from the well bore.
Figure 3B:
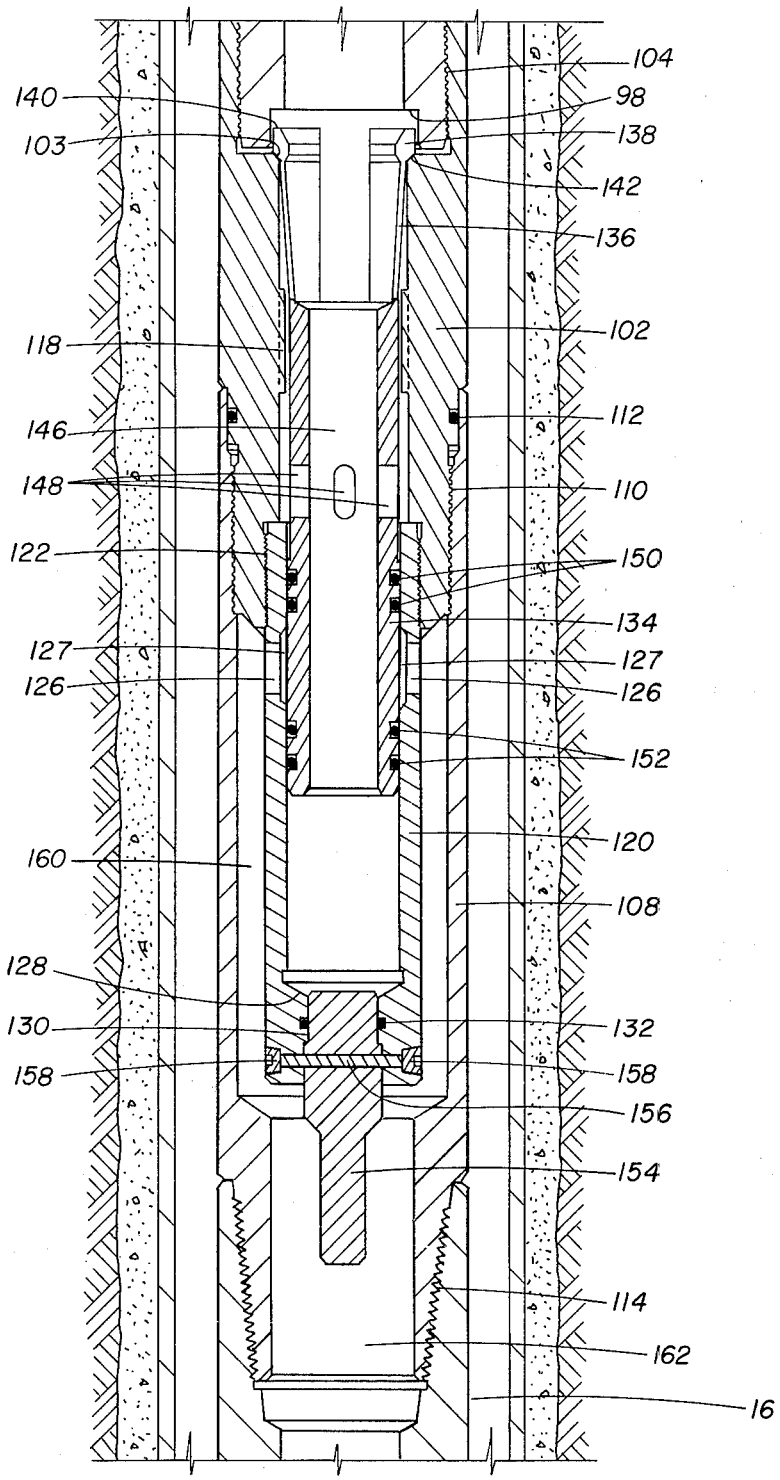

As rotation of pipe string 6 and stinger assembly 20 continues, aided by bearing 30, threads 70 on seal mandrel 58 become completely disengaged from threads 93 of upper body 92. When O-rings 74 on seal mandrel 58 reach short cylindrical bore 94 in upper adapter 92, the fluid seal between stinger assembly 20 and valve assembly 90 is broken, occurring slightly before the disengagement of threads between seal mandrel 58 and upper body 92. Pipe string 6, with stinger assembly 20 is raised to the surface (FIG. 3A), closed valve assembly 90 and the remainder of the pipe string below packer 16 being supported in casing 12 by the packer slips. The hydraulic hold-down on packer 16 prevents movement of the packer in casing 12 responsive to fluid pressure from below. Valve assembly 90 (FIGS. 3A and 3B) may be left in the casing throughout a storm or repair operations to a blowout preventor, being maintained in a closed position by the outward bias of spring fingers 136 of sliding valve 134.

When it is desired to reopen sliding valve 134, stinger assembly 20 is again lowered into the casing 12 on pipe string 6. Seal mandrel 58 will enter the valve assembly 90 as bearing retainer 32 contacts the top of upper body 92, the bottom of threads 70 on seal mandrel 58 being placed in contact with the top of threads 93 in upper body 92. Chamfered end 86 at the bottom of seal mandrel 58 will have been guided into bore diameter 96 by taper 95. Pipe string 6 is now rotated to the right, the axial bias of spring 46 in stinger assembly 20 causing threads 70 to be made up with threads 93, pulling seal mandrel 58 axially downward. Shortly after threads 70 and 93 engage, O-rings 74 on seal mandrel 58 will enter bore 96 to make a fluid seal, O-rings 74 being pulled into bore 96 and compressed therein in a controlled manner by the preceding thread engagement. As seal mandrel 58 continues downward, chamfered end 86 will contact shoulder 144 on sliding valve 134, forcing sliding valve 134 axially downward. When threads 70 are made up to the full extent of threads 93, lower bore 162 and seal mandrel bore 146 will once again be in communication through apertures 126 and apertures 148 (which are in their axial and radial alignment), resulting in pipe string bore 8 being opened to the well bore below packer 16.

If it is desired to remove or relocate subsurface control valve 10 from the well bore, an upward pull on pipe string 6 will result in the release of packer 16, due to its automatic J-slot, and subsurface control valve 10 may be withdrawn to the surface or repositioned by subsequent righthand rotation of pipe string 6.

If, for some reason, sliding valve 134 is damaged and cannot be opened seal mandrel 58 can be removed from stinger assembly 20, and a shortened mandrel substituted therefor. The stinger assembly 20 can then be made up with valve assembly 90, and plug 154 can be removed from lower bore 162 by the shearing of shear pin 156 through pump pressure at the surface or by the impact of sinker bars run on wire line. This will result in differential pressure across the packer being relieved, so that it can be more easily released and retrieved.

While the subsurface control valve of the present invention has been described with reference to a particular preferred embodiment and its operation, it will be apparent to one of ordinary skill in the art that certain modifications, additions and deletions may be made without departing from the spirit and scope of the invention. For example, and not by way of limitation, mandrel retainer 56 and seal mandrel 58 may be combined in one part; seal mandrel 58 could be made in two parts connected by a snap-ring to avoid the necessity of carrying a separate short mandrel to retrieve a valve assembly with a stuck sliding valve; a solid sleeve could be used on sliding valve 134 and spring fingers employed on the end of seal mandrel 58, an annular shoulder and snap-ring being used to stop and maintain sliding valve 134 in its closed position; bearing 30 could be held by upper body 92 instead of on stinger assembly 20; and others.

I claim:

1. A subsurface control valve, comprising:

a stinger assembly including a substantially cylindrical housing having an axial bore therethrough, a first annular interior shoulder at the top of said housing bore, a second annular interior shoulder at the bottom of said housing bore, annular bearing means at the lower end of said housing, and first spline means between said first and second annular shoulders on the wall of said housing bore, said housing bore containing at its upper end a coil spring adapted to downwardly bias a stinger slidably mounted in said housing bore, said stinger having an axial bore therethrough, second spline means adapted to cooperate with said first spline means on said housing, exterior threads below said spline means, and valve engagement means at its lowest extent;

a valve assembly having upper, median, and lower communicating bores therein, threads in said upper valve assembly bore adapted to cooperate with said stinger threads, axially closable valve means including a slidable valve sleeve in said median valve assembly bore, spline means between said median valve assembly bore and said valve sleeve adapted to prevent rotational movement therebetween, and port means through the wall of said median valve assembly bore adapted to communicate between said upper and lower valve assembly bores when ports in said valve sleeve are aligned therewith.

2. The apparatus of claim 1 wherein said valve assembly spline means include radially outwardly biased spring fingers having protrusions thereon at the top of said valve sleeve and grooves in which said protrusions ride on the wall of said median valve assembly.

3. The apparatus of claim 1 wherein said median valve assembly bore possesses an annular recess therein, said protrusions entering said recess when said sleeve valve ports and said port means are axially misaligned.

4. The apparatus of claim 3 wherein said valve engagement means comprises an upward-facing shoulder on said stinger, said stinger shoulder being engageable with said protrusions on said spring fingers when said protrusions are not in said recess in said median valve assembly bore.

5. The apparatus of claim 4 wherein said sliding valve sleeve possesses an upward-facing annular shoulder on the interior thereof, said sleeve shoulder being engageable with the lowest end of said stinger means.

6. The apparatus of claim 1 wherein said sliding valve sleeve is at its axially lowest extent when said threads of said stinger are fully made up with said threads in said upper valve assembly bore, and at its axially uppermost extent when said stinger threads are completely backed off from said upper valve assembly bore threads.

7. The apparatus of claim 1 wherein said bearing means rests on the top of said valve assembly housing when said stinger enters said upper bore.

8. The apparatus of claim 1 wherein said coil spring biases said stinger threads against said upper bore threads when said stinger is placed in said upper bore.

* * * * *